US005467983A

United States Patent [19]

Chen

[11] Patent Number: 5,467,983

[45] Date of Patent: Nov. 21, 1995

[54] GOLF WOODEN CLUB HEAD

[76] Inventor: Archer C. C. Chen, 35, Yichaone E. Road, Taipin, Taichung County, Taiwan

[21] Appl. No.: 294,364

[22] Filed: Aug. 23, 1994

[51] Int. Cl.[6] ..... A63B 53/04

[52] U.S. Cl. ..... 273/78; 273/167 H; 273/173

[58] Field of Search ..... 273/167 R, 167 A, 273/167 F, 167 H, 169, 170, 171, 172, 173, 174, 175, 78, DIG. 23, 79, 77 R

[56] References Cited

U.S. PATENT DOCUMENTS

| | | | |
|---|---|---|---|
| 723,258 | 3/1903 | Felton | 273/78 |
| 1,562,956 | 11/1925 | Guerne | 273/78 |
| 1,907,134 | 5/1933 | Weiskopf | 273/78 |
| 4,465,221 | 8/1984 | Schmidt | 273/173 |
| 4,681,321 | 7/1987 | Chen | 273/167 H |
| 4,730,830 | 3/1988 | Tilley | 273/173 |
| 4,884,812 | 12/1989 | Nagasaki | 273/167 H |
| 4,930,781 | 6/1990 | Allen | 273/78 |
| 5,106,094 | 4/1992 | Desbiolles | 273/167 H |
| 5,261,664 | 11/1993 | Anderson | 273/167 H |
| 5,271,621 | 12/1993 | Lo | 273/173 |
| 5,288,070 | 2/1994 | Chen | 273/78 |

FOREIGN PATENT DOCUMENTS

| | | | |
|---|---|---|---|
| 406142239 | 5/1994 | Japan | 273/78 |
| 2268412 | 1/1994 | United Kingdom | 273/167 H |
| 93000968 | 1/1993 | WIPO | 273/167 H |

*Primary Examiner*—Sebastiano Passaniti
*Attorney, Agent, or Firm*—Browdy and Neimark

[57] ABSTRACT

A golf wooden club head comprises a casing, a bottom plate, a base plate, a support layer and a ball-striking plate. The hollow casing is provided with an opening and a shoulder which is provided with a ring-shaped shoulder surface coplanar with one surface of the shoulder and facing outwards. The shoulder is further provided with a rib having a surface which is facing outwards and coplanar with the shoulder surface. A receiving space is formed between the shoulder surface and the front surface open end. The bottom opening is sealed off with the bottom plate. The base plate is disposed in the shoulder surface for separating the receiving space from interior space of the casing. The support layer is disposed in the receiving space such that the support layer is formed integrally with the ball-striking plate.

1 Claim, 4 Drawing Sheets

GOLF WOODEN CLUB HEAD

FIELD OF THE INVENTION

The present invention relates generally to a golf wooden club head, and more particularly to an improvement in the golf wooden club head.

BACKGROUND OF THE INVENTION

As shown in FIG. 1, a prior art golf wooden club head 10 comprises a casing 11 made of stainless steel by casting. The casing 11 has a thick front face in which a ball-striking face 12 is formed. Located in the back face of the casing 11 is an opening 13, which is to facilitate the stripping and is sealed off by a metal plate 14.

The golf wooden club head 10 of the prior art described above has inherent shortcomings. In the first place, the center of gravity of the golf wooden club head 10 is bound to concentrate on the ball-striking face 12 which is relatively thick. In addition, the metal ball-striking face 12 is rather vulnerable to deformation upon being impacted on by a golf ball. It is difficult for a golf player to control the traveling direction of a golf ball with a golf wooden club head having a deformed ball-striking face.

The above-mentioned shortcomings are overcome by a golf wooden club head which is provided on the front face thereof with a ball-striking plate made of a light and rigid material. The U.S. Pat. No. 4,749,197 discloses a golf club head having a ball-striking plate made of titanium. In addition, a golf wooden club head is provided in the front face thereof with a dovetail slot into which the ball-striking plate is fitted securely.

The ball-striking plates mentioned above are also defective in design in that they have a back face which is not evenly supported, and that they are therefore rather susceptible to deformation upon being impacted on by a golf ball. If the ball-striking plates are thickened, they are bound to become heavier. As a result, the center of gravity of the golf wooden club head will concentrate on the ball-striking plate. In addition, such ball-striking plates as described above can not be made of a rigid and breakable material like a ceramic material.

SUMMARY OF THE INVENTION

It is therefore the primary objective of the present invention to provide a golf wooden club head with a lightweight ball-striking face.

It is another objective of the present invention to provide a golf wooden club head with a ball-striking face made of a thin metal material or a ceramic material.

It is still another objective of the present invention to provide a golf wooden club head with a ball-striking face having various anti-elastic and shock-absorbing characteristics according to the player's requirements.

In keeping with the principle of the present invention, the foregoing objectives of the present invention are attained by a golf wooden club head, which comprises a casing, a bottom plate, a base plate, a support layer and a ball-striking plate. The casing of a hollow construction is provided with an opening and a shoulder. The shoulder is provided with a ring-shaped shoulder surface coplanar with one surface of the shoulder and facing outwards. The shoulder is further provided with a rib having a surface which is facing outwards and coplanar with the shoulder surface. A receiving space is formed between the shoulder surface and the front surface open end. The bottom opening is sealed off with the bottom plate. The base plate is disposed in the shoulder surface for separating the receiving space from the interior space of the casing so that the interior of the casing is airtight and that the receiving space forms a recessed slot. The support layer of a fiber-reinforced resin bulk molding compound is received in the recessed slot and hardened under heat and pressure. The ball-striking plate is formed integrally with the support layer.

DETAILED DESCRIPTION OF THE INVENTION

Figure 1:
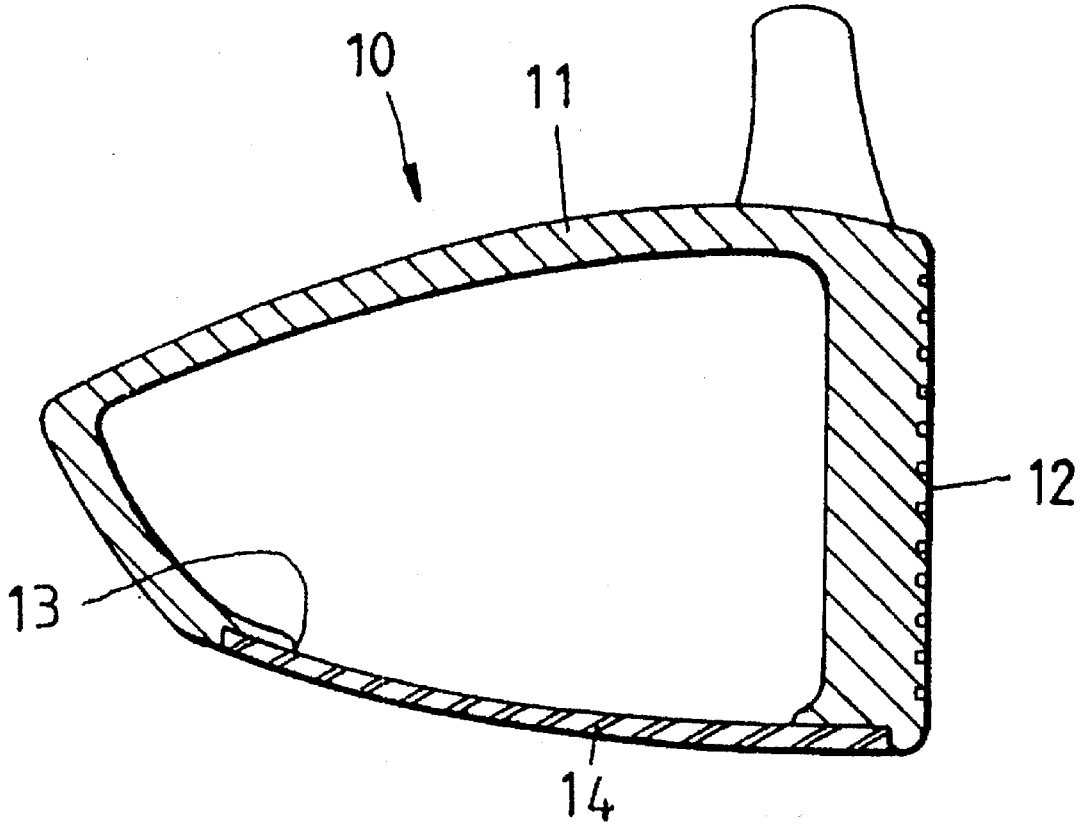
FIG. 1 PRIOR ART
FIG. 1 shows a sectional view of a prior art golf wooden club head made of a metal material.
Figure 2:
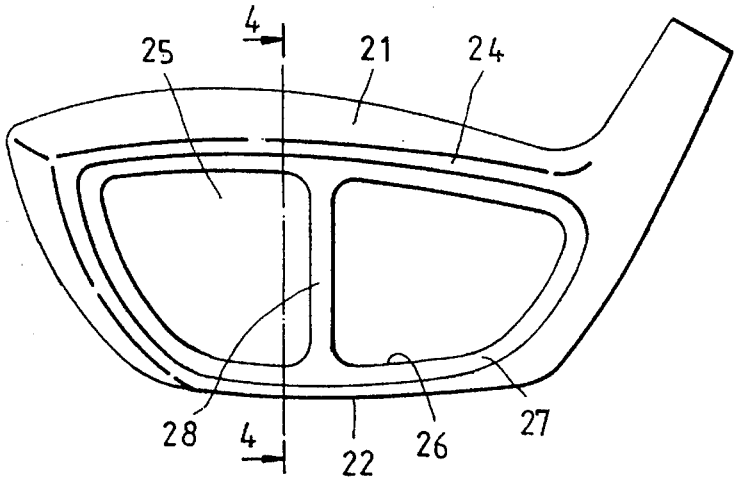
FIG. 2 shows a front elevational view of a casing of a first preferred embodiment of the present invention.
Figure 3:
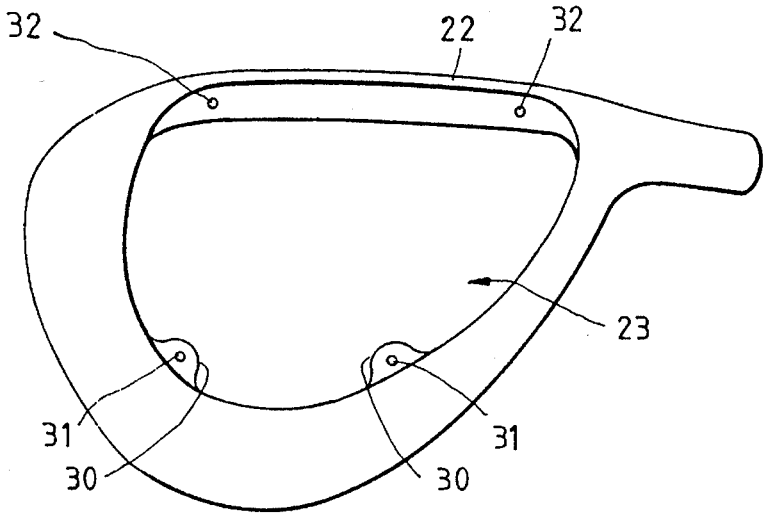
FIG. 3 shows a bottom view of the casing of the first preferred embodiment of the present invention.
Figure 4:
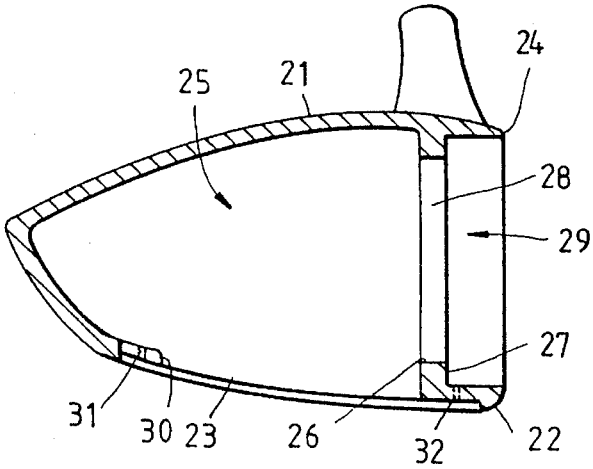
FIG. 4 shows a sectional view of a portion taken along the line 4—4 as shown in FIG. 2.

As shown in FIGS. 2, 3 and 4, a golf club head of the first preferred embodiment of the present invention comprises the component parts described hereinafter.

A casing 21 is made by castig or plastic injection molding and provided with a bottom surface 22 having an opening 23, a front surface 24 which is recessed inwards such that it is in communication with an interior space 25, and a shoulder 26 extending along the periphery of the open end. The outer face of the shoulder 26 has a ring-shaped shoulder surface 27. The shoulder 26 is provided centrally with a rib portion 28 extending from the top wall to the bottom wall. The rib portion 28 has an outer surface which is coplanar with the shoulder surface 27. Located between the shoulder surface 27 and the front surface 24 open end is a receiving space 29. The opening 23 of the bottom surface 22 is provided respectively on both sides thereof with a lug 30 which is provided centrally with a hole 31. The bottom surface 22 located at the position of the receiving space 29 is provided respectively on both sides thereof with a hole 32.

Figure 5:
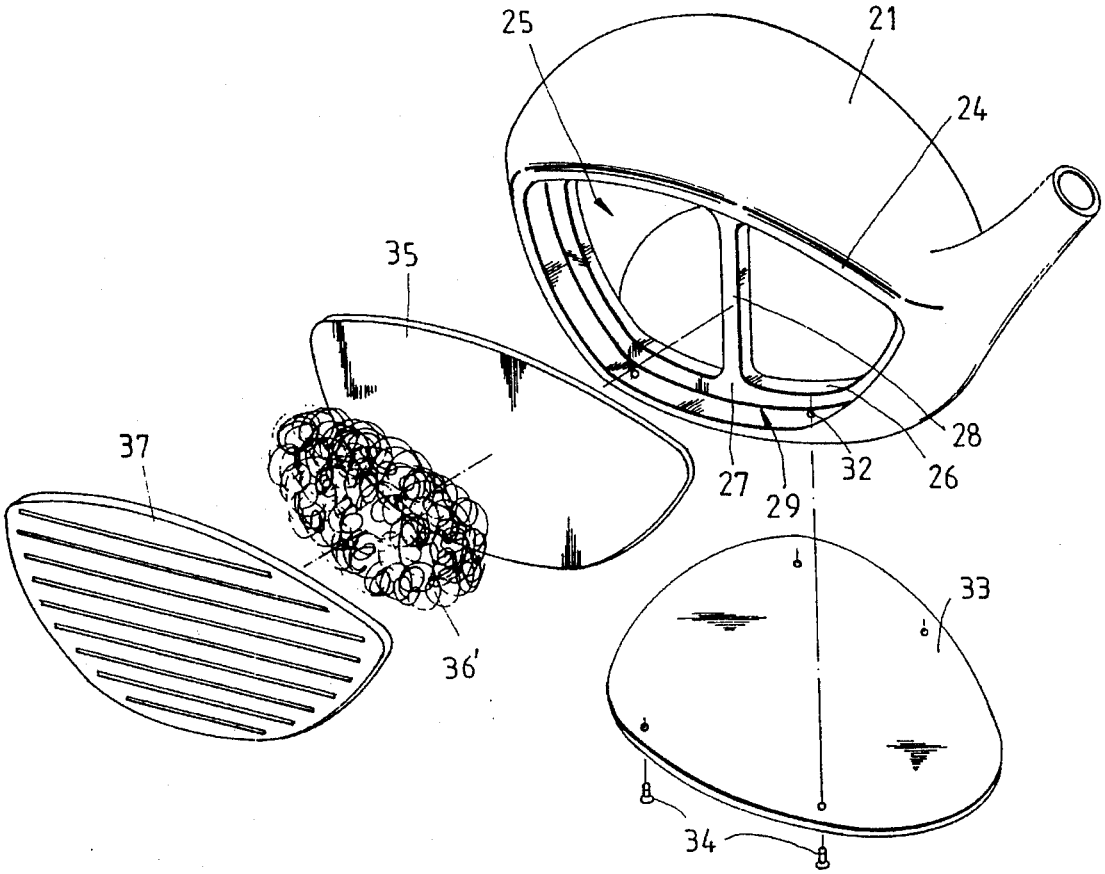
FIG. 5 shows an exploded view of the casing of the first preferred embodiment of the present invention.
Figure 6:
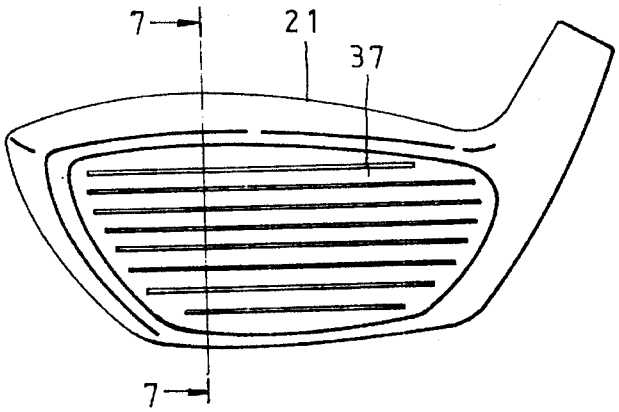
FIG. 6 shows a front view of the first preferred embodiment of the present invention.
Figure 7:
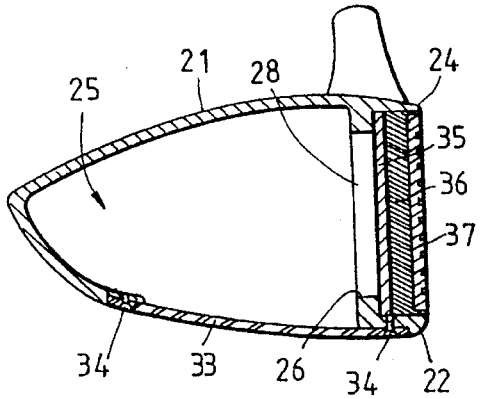
FIG. 7 shows a sectional view of a portion taken along the line 7—7 as shown in FIG. 6.

As shown in FIGS. 5,6 and 7, a bottom plate 33 is fastened to the bottom surface 22 of the casing 21 by means of four screws 34 engageable with holes 31 and 32. The opening 23 is sealed off by the bottom plate 33.

A base plate 35 is disposed on the shoulder surface 27 for separating the receiving space 29 from the interior space 25 such that the interior space 25 is airtight and that the receiving space 29 is used as a recessed slot 29.

A support layer 36 is made of a bulk molding compound 36' of a fiber-reinforced resin and is disposed in the recessed slot 29. The bulk molding compound 36' is hardened under heat and pressure for forming on the ball-striking surface a lightweight structural body.

A ball-striking plate 37 is pre-arranged on the bulk molding compound and made integrally with the support layer 36 for forming the ball-striking surface of the golf club head.

The base plate 35 may be made of a fiber-reinforced resin, an aluminum material, a copper material, a titanium material, a stainless steel material, or an alloy of the above-mentioned metal materials. In addition, the base plate 35 may be made of a plastic hard plate or a hard plate of other materials. The base plate 35 can be adhered to the shoulder surface 27. If the base plate 35 is made of a metal material, the base plate 35 may be fastened to the shoulder surface 27 by welding.

The ball-striking plate 37 may be made of a ceramic material and provided thereon in advance with scoring lines. The ball-striking plate 37 may be made of titanium, stainless steel, copper, aluminum, or an alloy, and provided integrally with scoring lines. The above-mentioned metals may be pressed to form thin plates, which are then provided integrally with scoring lines by punching and pressing.

Figure 8:
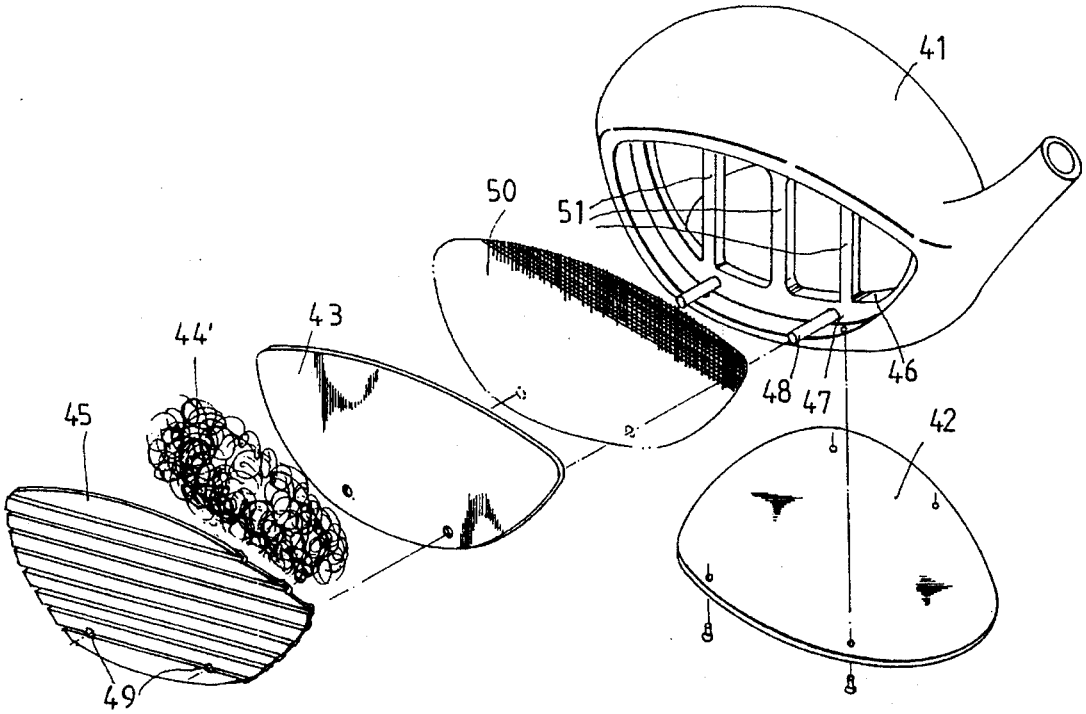
FIG. 8 shows an exploded view of a second preferred embodiment of the present invention.
Figure 9:
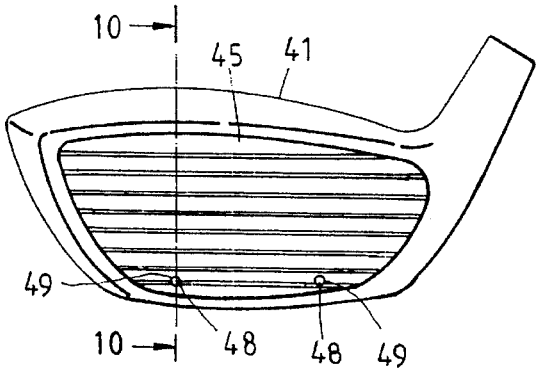
FIG. 9 shows a front view of the second preferred embodiment of the present invention.
Figure 10:
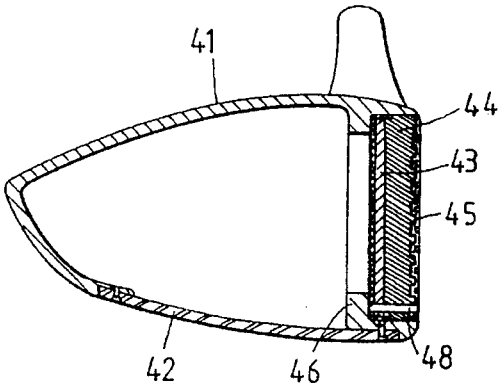
FIG. 10 shows a sectional view of a portion taken along the line 10—10 as shown in FIG. 9.

As shown in FIGS. 8, 9 and 10, the club head of the second preferred embodiment of the present invention comprises a casing 41, a bottom plate 42, a base plate 43, a support layer 44, and a ball-striking plate 45. The club head of the second preferred embodiment of the present invention is similar in construction to that of the first preferred embodiment of the present invention, with the only difference being that the shoulder 46 of the casing 41 is provided respectively on both sides of the underside thereof with a shoulder surface 47 having a projection 48 extending outwards and perpendicular to the shoulder surface 47. The ball-striking plate 45 is provided with two through holes 49 corresponding in location to and engageable with the two projections 48. In other words, the ball-striking plate 45 can be precisely located by means of the two projections 48. The projections 48 may have an extra portion extending beyond the surface of the ball-striking plate 45. The extra portion referred to above may be removed by cutting or abrasive means. In addition, the base plate 43 is provided on the back thereof with a resin-impregnated fiber cloth 50. The base plate 43 is then disposed on the shoulder surface 47 such that the fiber cloth 50 is adhered securely to the shoulder surface 47. Moreover, the shoulder 46 of the casing 41 is provided with three ribs 51.

The golf club head of the present invention has inherent advantages, which are expounded explicitly hereinafter.

The golf club head of the present invention has a ball-striking surface which is light in weight in view of the fact that the support layer is made of a fiber-reinforced resin which has a specific gravity of 1.6 or so, and that the ball-striking plate is thin and light in weight, thereby permitting the center of gravity of the golf club head of the present invention to be located rearwards and downwards.

The ball-striking plate of the present invention may be made of a ceramic material or a thin metal plate in view of the fact that the golf club head of the present invention is provided with a support layer of a fiber-reinforced resin material, which affords a solid and strong support to the back of the ball-striking plate without leaving therebetween the gaps or the air bubbles. The ball-striking plate of a ceramic material or a thin metal plate can not be used in the golf club heads of the prior art.

The golf club head of the present invention is provided with the support layer of a fiber-reinforced resin material, which accounts for the fact that the golf club head of the present invention is endowed with superior anti-elastic and shock-absorbing qualities.

The base plate and the ball-striking plate of the golf club head of the present invention may be made of various materials in accordance with the anti-elastic and shock-absorbing requirements which may vary among the golf players.

What is claimed is:

1. A golf wooden club head comprising:

a casing of a hollow construction and provided in a bottom surface thereof with an opening and further provided with a recessed front surface in communication with an interior space of said casing having an inner wall provided with a shoulder which is located a predetermined distance from a front surface open end and which extends around the edge of said open end, said shoulder having a ring-shaped shoulder surface which is provided with at least a rib portion having a surface which faces outwards and is coplanar with said shoulder surface, said front surface open end forming a receiving space in conjunction with said shoulder surface;

a bottom plate fastened to said bottom surface of said casing such that said opening of said bottom surface is sealed off by said bottom plate;

a base plate fastened to said shoulder surface for separating said receiving space from said interior space of said casing so as to make said interior space airtight and to make said receiving space a recessed slot;

a support layer made of a bulk molding compound of a fiber-reinforced resin material, said support layer forming a part of a ball-striking surface of a golf wooded club head by being hardened in said recessed slot under heat and pressure; and a ball-striking plate pre-arranged on said bulk molding compound and made integrally with said support layer for forming said ball-striking surface of said wooden club head;

wherein said shoulder of said casing is provided with at least two projections extending outwards and perpendicular to said shoulder surface; and wherein said ball-striking plate is provided with at least two holes corresponding in location to and engageable with said two projections.

* * * * *